US008494419B2

(12) United States Patent
Shiraki et al.

(10) Patent No.: US 8,494,419 B2
(45) Date of Patent: Jul. 23, 2013

(54) PROCESSING UNIT INCLUDING DEVELOPING ROLLER HAVING ROLLER BODY AND COVERING LAYER COVERING CIRCUMFERENTIAL SURFACE OF ROLLER BODY, AND SUPPORTING MEMBER THAT SUPPORTS DEVELOPING ROLLER

(75) Inventors: Masatoshi Shiraki, Nagoya (JP); Hiroshi Handa, Aisai (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 293 days.

(21) Appl. No.: 13/016,254

(22) Filed: Jan. 28, 2011

(65) Prior Publication Data

US 2011/0182627 A1 Jul. 28, 2011

(30) Foreign Application Priority Data

Jan. 28, 2010 (JP) ..... 2010-016354

(51) Int. Cl.
*G03G 15/08* (2006.01)

(52) U.S. Cl.
USPC ..... 399/279

(58) Field of Classification Search
USPC ..... 399/111, 119, 279, 286
See application file for complete search history.

(56) References Cited

U.S. PATENT DOCUMENTS

| | | | | |
|---|---|---|---|---|
| 5,682,587 | A | 10/1997 | Higeta et al. | |
| 6,999,706 | B2 * | 2/2006 | Morioka et al. | 399/279 |
| 2005/0201772 | A1 | 9/2005 | Ishii et al. | |

FOREIGN PATENT DOCUMENTS

| | | | |
|---|---|---|---|
| JP | 07-175325 | | 7/1995 |
| JP | 08-022195 | | 1/1996 |
| JP | 09-146327 | A | 6/1997 |
| JP | 2000-066507 | A | 3/2000 |
| JP | 2001-022177 | A | 1/2001 |
| JP | 2002-187171 | | 7/2002 |
| JP | 3464088 | B2 | 11/2003 |
| JP | 2004-093702 | | 3/2004 |
| JP | 2005-258344 | A | 9/2005 |
| JP | 2006-030505 | | 2/2006 |
| JP | 2008-151324 | | 7/2008 |

OTHER PUBLICATIONS

JP Office Action dtd Dec. 20, 2011, JP Appln. 2010-016354, English Translation.

CN Office Action dtd Jun. 19, 2012 in corresponding CN Application No. 201110033047.4; English Translation.

* cited by examiner

*Primary Examiner* — William J Royer
(74) *Attorney, Agent, or Firm* — Banner & Witcoff, Ltd.

(57) ABSTRACT

A processing unit is provided. The processing unit includes: a housing; a developing roller that carries developer on a surface thereof, the developing roller including, a roller body, and a covering layer covering an outer circumferential surface of the roller body; a photosensitive drum that contacts the developing roller, wherein an end face of the photosensitive drum at a first side in an axial direction of the developing roller is located at an outer side in the axial direction compared to an end face of the developing roller at the first side in the axial direction, and wherein the developer on the developing roller is supplied to the photosensitive drum; and a supporting member that contacts an inner circumferential surface of the roller body at the first side in the axial direction, and supports the developing roller rotatably in the housing.

10 Claims, 11 Drawing Sheets

PROCESSING UNIT INCLUDING DEVELOPING ROLLER HAVING ROLLER BODY AND COVERING LAYER COVERING CIRCUMFERENTIAL SURFACE OF ROLLER BODY, AND SUPPORTING MEMBER THAT SUPPORTS DEVELOPING ROLLER

CROSS-REFERENCE TO RELATED APPLICATIONS

This application claims priority from Japanese Patent Application No. 2010-016354 filed on Jan. 28, 2010, the entire contents of which are incorporated herein by reference.

TECHNICAL FIELD

Aspects of the present invention relates to a processing unit including a developing roller that carries developer on a surface thereof.

BACKGROUND

In an image forming apparatus such as a laser printer, a processing unit, which includes a casing, a developing roller that is rotatably supported by the casing, and a photosensitive drum which is opposed to the developing roller and on which an electrostatic latent image is formed, is provided. When toner that is carried on the developing roller opposes the electrostatic latent image of the photosensitive drum, a visible image is formed due to the toner being selectively transferred to the electrostatic latent image.

Related-art discloses a developing roller used in such an image forming apparatus. The related-art developing roller is formed by providing an elastic rubber layer around a metal shaft. However, because a metal core cut from steel is used in the metal shaft, there is a problem that the weight of the developing roller increases.

In view of this problem, related-art discloses a developing roller formed by providing a thin elastic rubber layer around a hollow pipe and press fitting a flange having a shaft into both ends of the pipe (JP-A-2000-275955). Thereby, the weight of the developing roller is reduced.

When assembling the related-art developing roller including a hollow pipe to a casing, the flange having a shaft is received by a shaft receiving unit, so as to be supported by the casing. Thus, as there are multiple elements between the hollow pipe and the casing, an axial accuracy of the developing roller to the casing becomes low.

The axial accuracy of the developing roller to the casing can be improved by not attaching the flange to the hollow pipe but supporting an outer circumference of the hollow pipe by a supporting member and attaching a pipe section directly to the casing. However, as there is little difference between an outer diameter of the developing roller including the elastic rubber layer and an outer diameter of the pipe section, when the outer circumference of the pipe section is supported by the supporting member, the supporting member interferes with the photosensitive drum.

SUMMARY

Accordingly, it is an aspect of the present invention to provide a processing unit, wherein a supporting member that supports a hollow pipe type developing roller in a casing does not interfere with a photosensitive drum when the developing roller is attached to the casing, thereby enabling the developing roller to be assembled into the casing in high axial accuracy.

According to an exemplary embodiment of the present invention, there is provided a processing unit, comprising: a housing; a developing roller that carries developer on a surface thereof, the developing roller including, a hollow roller body, and a covering layer covering an outer circumferential surface of the roller body; a photosensitive drum that contacts the developing roller, wherein an end face of the photosensitive drum at a first side in an axial direction of the developing roller is located at an outer side in the axial direction compared to an end face of the developing roller at the first side in the axial direction, and wherein the developer on the developing roller is supplied to the photosensitive drum; and a supporting member that contacts an inner circumferential surface of the roller body at the first side in the axial direction, and supports the developing roller rotatably in the housing.

DETAILED DESCRIPTION

Hereinafter, exemplary embodiments of the present invention will be described in detail with reference to the drawings.

Figure 1:
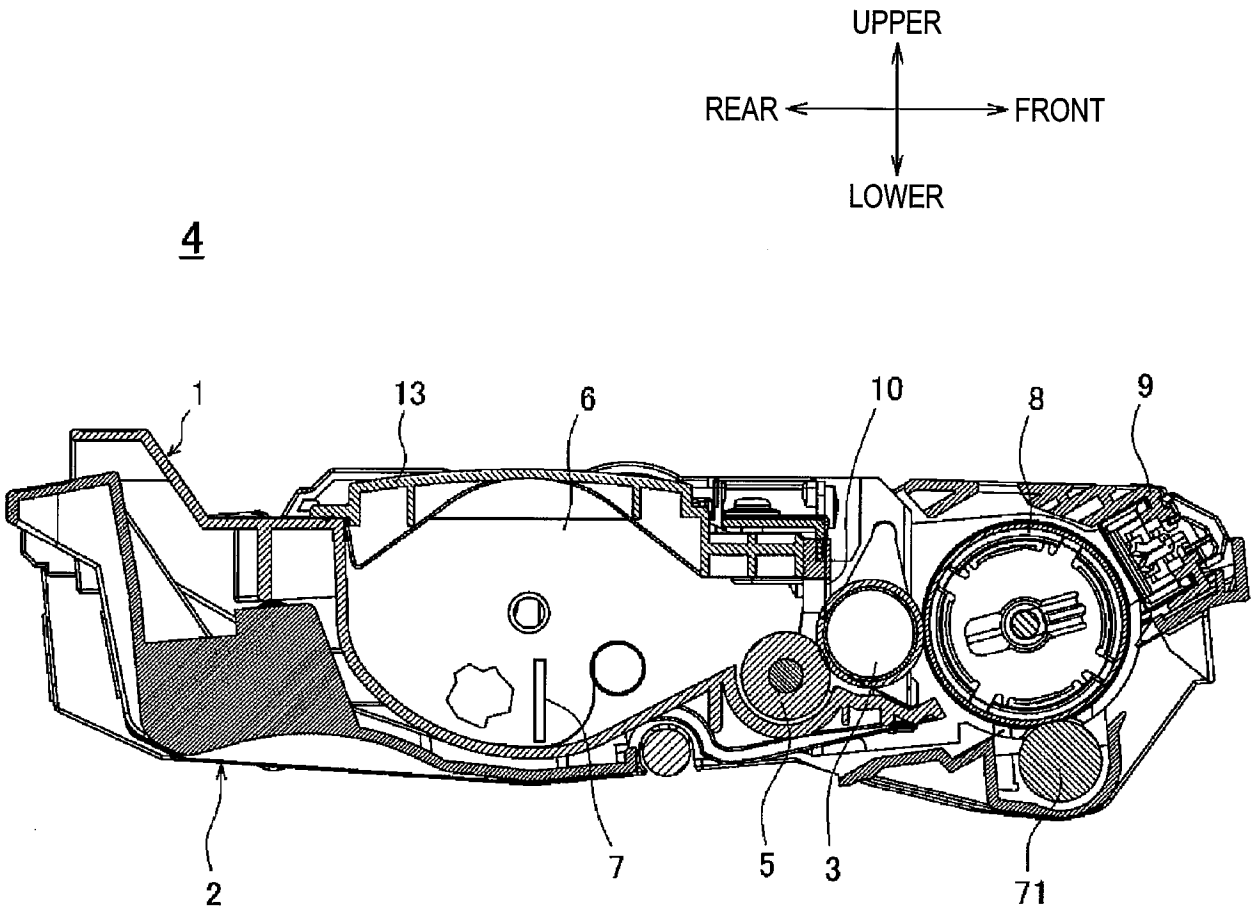
FIG. 1 is a central section view of a processing unit.

In FIG. 1, the right side of the sheet plane is defined as the front side of a processing unit 4 and the left side of the sheet plane is defined as the rear side of the processing unit 4. Further, the side of a left hand when the processing unit 4 is viewed from the front side (the front surface side of the sheet plane) is defined as the left side, and the opposite side (the back surface side of the sheet plane) is defined as the right side. Based on these definitions, the front and rear, right and left, and vertical directions, respectively, are indicated in FIG. 1. The respective directions shown in FIGS. 2 to 12 are all indicated so as to correspond to the respective directions shown in FIG. 1.

First, a configuration of a the processing unit 4 installed on a laser printer body (not shown) will be described with reference to FIG. 1.

The processing unit 4 includes a drum cartridge 2 including a photosensitive drum 8, and a developer cartridge 1 that can be removably installed to the drum cartridge 2. The developer cartridge 1 can be removed from the laser printer body in a state where it is installed to the drum cartridge 2.

The developer cartridge 1 mainly includes a developing roller 3, a layer thickness regulating blade 10, a supply roller 5 and an agitator 7 in a developing casing 13 that is a housing. Left and right ends of the photosensitive drum 8 extend further in an axial direction (left-right direction) compared to left and right ends of the developing roller 3 (see FIG. 11).

A toner storage chamber 6 that stores the agitator 7 is provided at the back side of the developing casing 13. In the developer cartridge 1, after toner that is an example of developer in the toner storage chamber 6 is stirred by the agitator 7, the toner is supplied to the developing roller 3 by the supply roller 5. Here, the toner gains positive charge produced by friction between the supply roller 5 and the developing roller 3. With rotation of the developing roller 3, the toner supplied to the developing roller 3 enters between the layer thickness regulating blade 10 and the developing roller 3, is further charged by friction, and is carried by the developing roller 3 in a thin layer state having a constant thickness.

The drum cartridge 2 mainly includes the photosensitive drum 8, a scorotron charger 9 and a transfer roller 71. Thus, in the drum cartridge 2, after a surface of the photosensitive drum 8 is uniformly positively charged by the scorotron charger 9, the surface is exposed by high-speed scanning of a laser beam from a scanner unit (not shown) provided in the laser printer body. A potential of exposed areas decrease thereby, and an electrostatic latent image based on image data is formed.

Next, by rotating the developing roller 3, the toner carried by the developing roller 3 is supplied to the electrostatic latent image formed on the surface of the photosensitive drum 8, and a toner image is formed on the surface of the photosensitive drum 8. After that, the toner image carried on the surface of the photosensitive drum 8 is transferred to a sheet by conveying the sheet between the photosensitive drum 8 and the transfer roller 71.

Hereinafter, the developer cartridge 1 will be described with reference to FIG. 2 to FIG. 12.

First, the developing roller 3 will be described.

Figure 2:
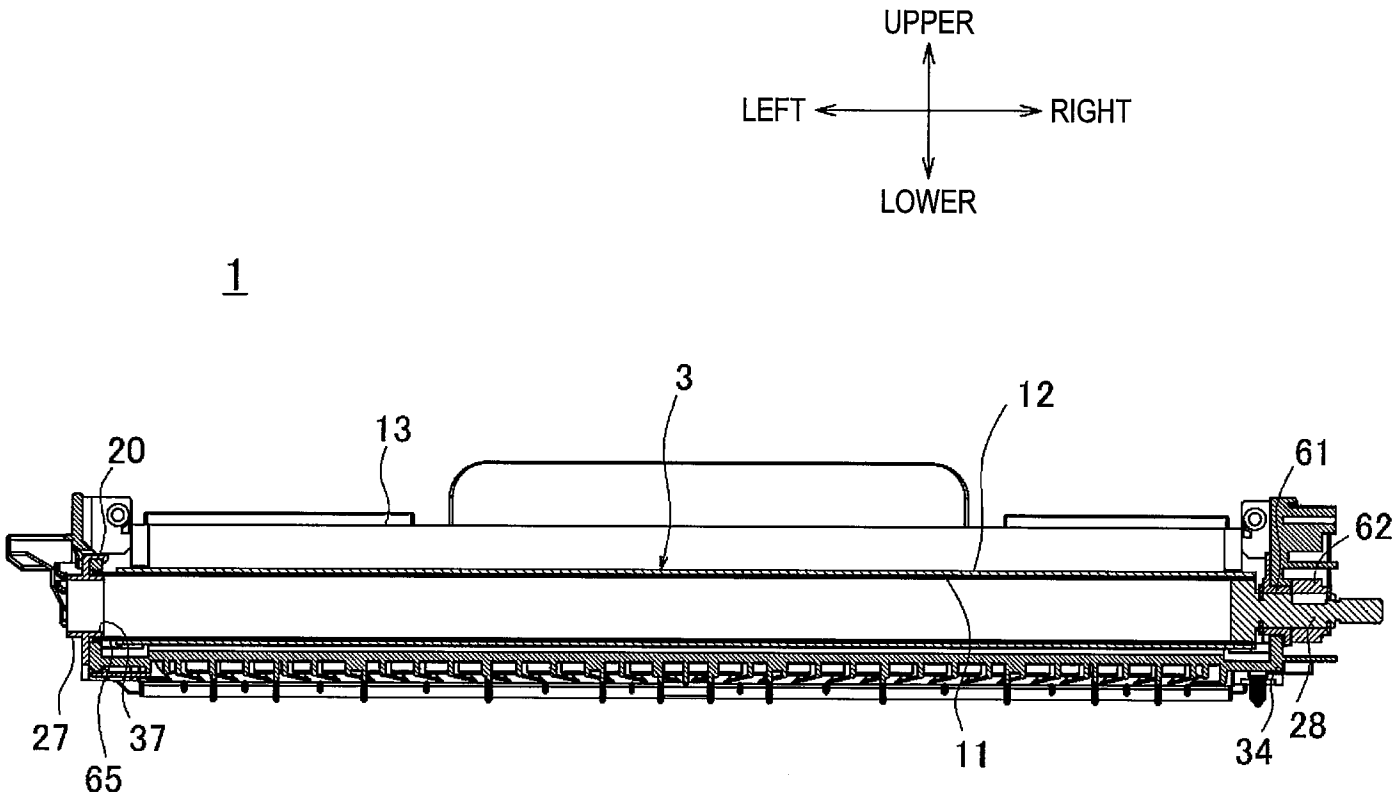
FIG. 2 is a section view of a developer cartridge.

As shown in FIG. 2, the developing roller 3 includes a hollow roller body 11 formed by metal such as aluminum, and an elastic rubber layer 12 that is a covering layer formed by conductive rubber to cover a surface of the roller body 11.

At a left end of the developing roller 3, the roller body 11 extends further than the elastic rubber layer 12, so as to form an extension part 65. The extension part 65 extends to a left attaching groove 21, which will be described later, when the developing roller 3 is attached to the developing casing 13. In the exemplary embodiment, the thickness of the elastic rubber layer 12 is 2 mm. By using such a developing roller in a contact developing method of the exemplary embodiment, a sufficient nip amount can be assured.

Figure 12:
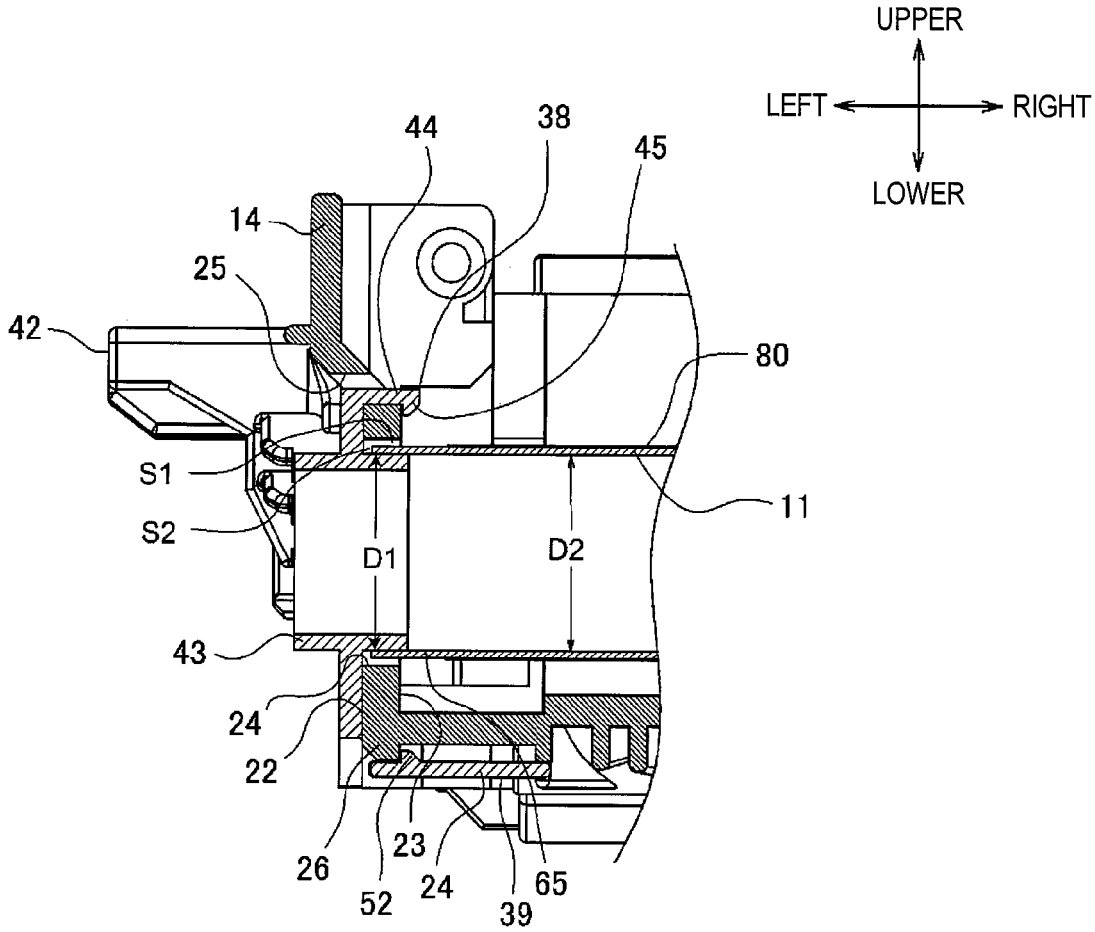
FIG. 12 is a diagram showing another example of a developing roller.

Meanwhile, as shown in FIG. 12, a covering layer 80 may be formed by coating a coating solvent on the surface of the roller body 11 of the developing roller. In this case, the thickness of the covering layer 80 is about 0.1 mm. Such developing roller has high environmental stability and can be produced at low cost.

Figure 4:
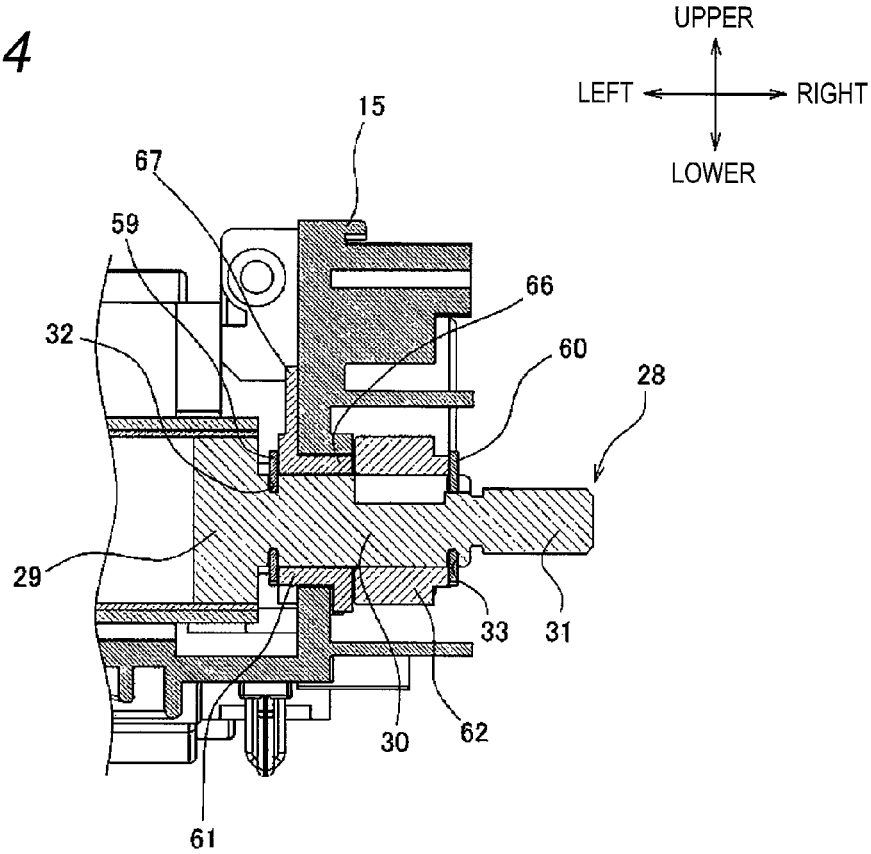
FIG. 4 is an enlarged diagram showing a right end of the developer cartridge shown in FIG. 2.

A shaft end 28 is provided at the right end of the developing roller 3. As shown in FIG. 4, the shaft end 28 includes a flange 29 pressed into the roller body 11, a first shaft 30, a diameter of which is smaller than that of the flange 29, and a second shaft 31, a diameter of which is further smaller than that of the first shaft 30.

A shaft receiving member 61 and a developing roller gear 62, which will be described later, are fitted to an outer circumferential surface of the first shaft 30. In addition, a first groove 32 is formed between the flange 29 and the first shaft 30, and a second groove 33 is formed between the first shaft 30 and the second shaft 31.

When the developer cartridge 1 is installed on the laser printer body, a collar which will be described later is attached to the second shaft 31. By securing the collar in the grooves (not shown) formed to the laser printer body, the position of the processing unit 4 in relation to the laser printer body is determined.

Hereinafter, the developing casing 13 will be described.

Figure 5:
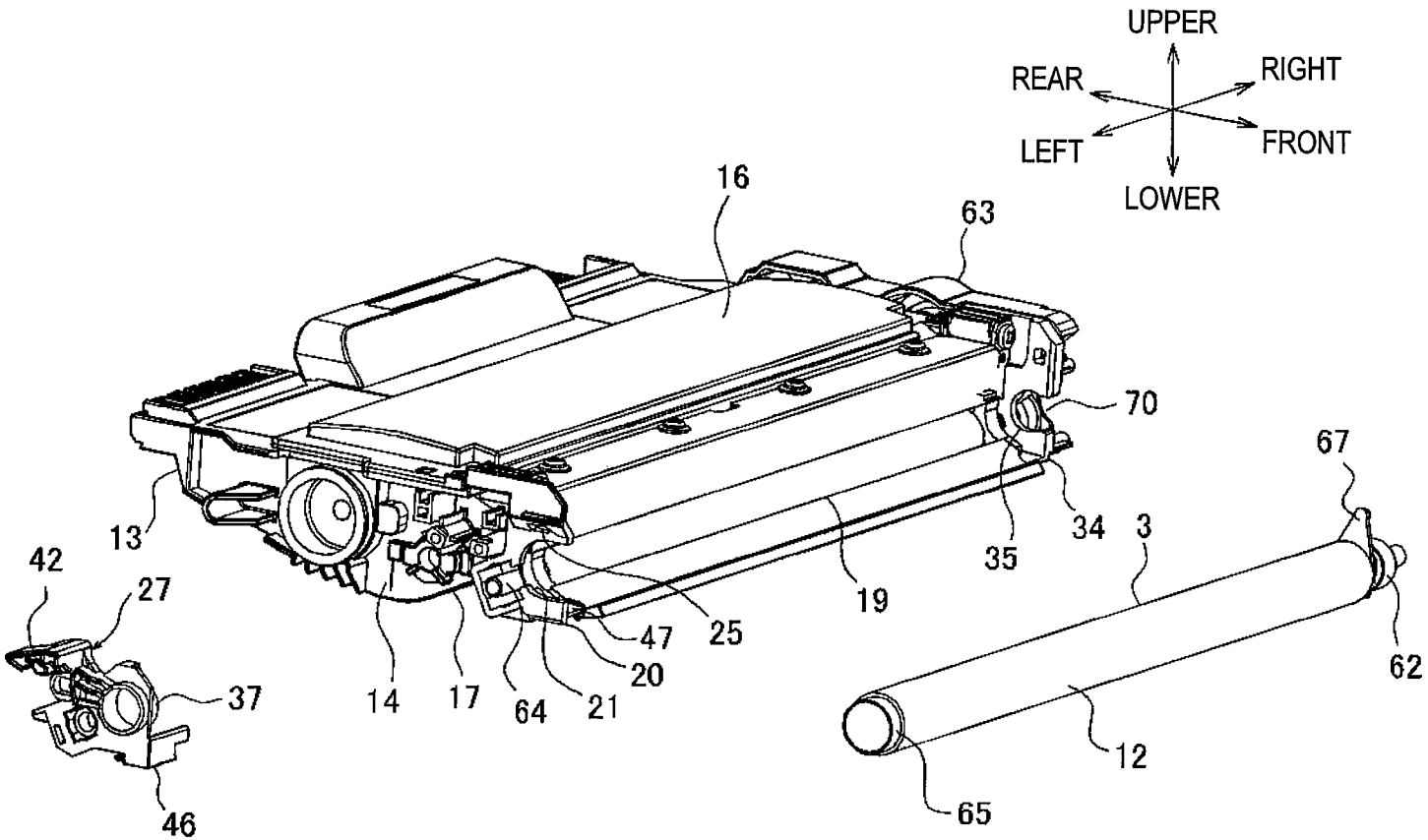
FIG. 5 is an exploded perspective view of the developer cartridge.
Figure 6:
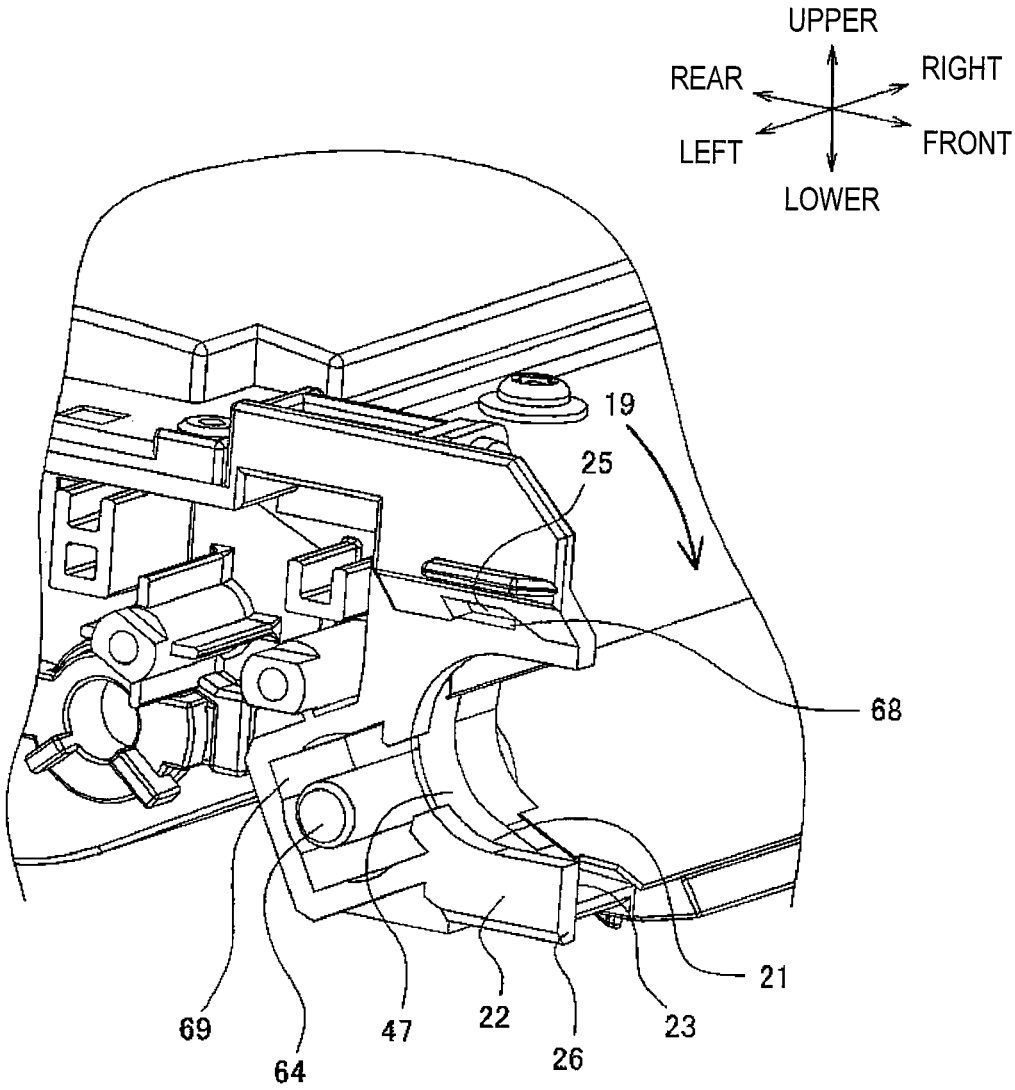
FIG. 6 is an enlarged diagram of a left end of a developing casing of FIG. 5.

As shown in FIG. 5, the developing casing 13 includes a pair of left and right sidewalls 14 and 15 opposed to each other in the axial direction, a top wall 16 provided between upper edges of the left and right sidewalls 14 and 15, a bottom wall 17 provided between lower edges of the left and right sidewalls 14 and 15, and a back wall 18 (see FIG. 10) provided between back edges of the left and right sidewalls 14 and 15. The pair of left and right sidewalls 14 and 15, the top wall 16, the bottom wall 17 and the back wall 18 are integrally formed with each other. In addition, an opening 19 that exposes the developing roller 3 is formed to the developing casing 13, by the front edges of the left and right sidewalls 14 and 15, the top wall 16 and the bottom wall 17.

First, the left end of the developing casing 13 will be described.

A left partition 20 that partitions the opening 19 is provided at the left sidewall 14. In the left partition 20, the left attaching groove 21 that is cut toward the rear side in an arc-shape is formed. The left end of the developing roller 3 is supported by the developing casing 13 by attaching a supporting member 27 which will be described later to the left attaching groove 21.

A first engaged portion 68 that engages with a first engaging portion 38 of the supporting member 27 which will be described later is provided upper to the left attaching groove 21. The first engaged portion 68 includes a rectangular engaging hole 25 that passes through a left surface 22 and a right surface 23.

Figure 3:
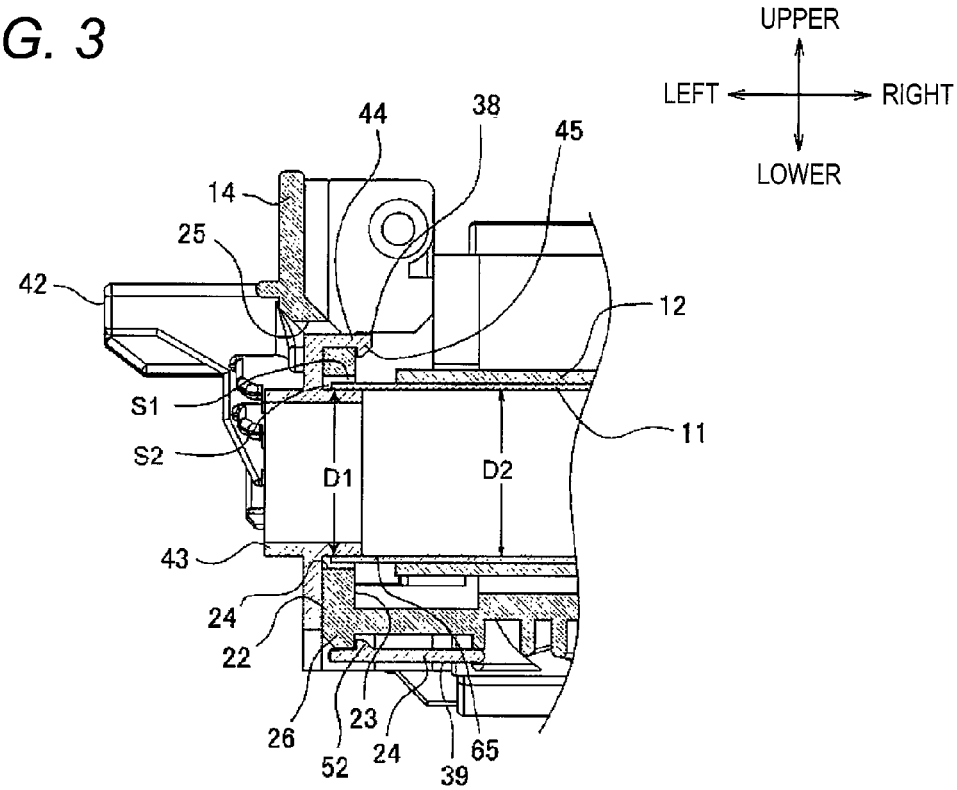
FIG. 3 is an enlarged diagram showing a left end of the developer cartridge shown in FIG. 2.

A side seal attaching portion 47 that extends along a circumferential direction of the developing roller 3, and to which a side seal (not shown) for preventing leakage of the developer, is provided to the left partition 20 in the axial direction. In addition, a second engaged portion 26 that engages with a second engaging portion 39 which will be described later is provided lower to the left partition 20. As shown in FIG. 3, the second engaged portion 26 protrudes downwards from the side seal attaching portion 47 and engages with a second engaging claw 52 which will be described later at the right side of a protrusion.

A rectangular groove 69 to which an outer frame 55 of the supporting member 27, which will be described later, is fitted is provided at the back of the left partition 20. A shaft 64 of the supply roller 5 protrudes from the center of the rectangular groove 69. A third engaged portion (not shown) that engages with a third engaging portion 40 which will be described later is provided at the rear side of the rectangular groove 69.

The right sidewall 15 includes a right partition 34 that partitions the opening 19. In the right partition 34, a right attaching groove 35 that is cut toward the rear side in an arc-shape is formed. The right attaching groove 35 has an opening 70 at the front end thereof, and the right end of the developing roller 3 is supported by the developing casing 13 by fitting the shaft receiving member 61 which will be described later into the opening 70.

The supporting member 27 that attaches the left end of the developing roller 3 to the developing casing 13 is attached to the left sidewall 14 of the developer cartridge 1.

Figure 7:
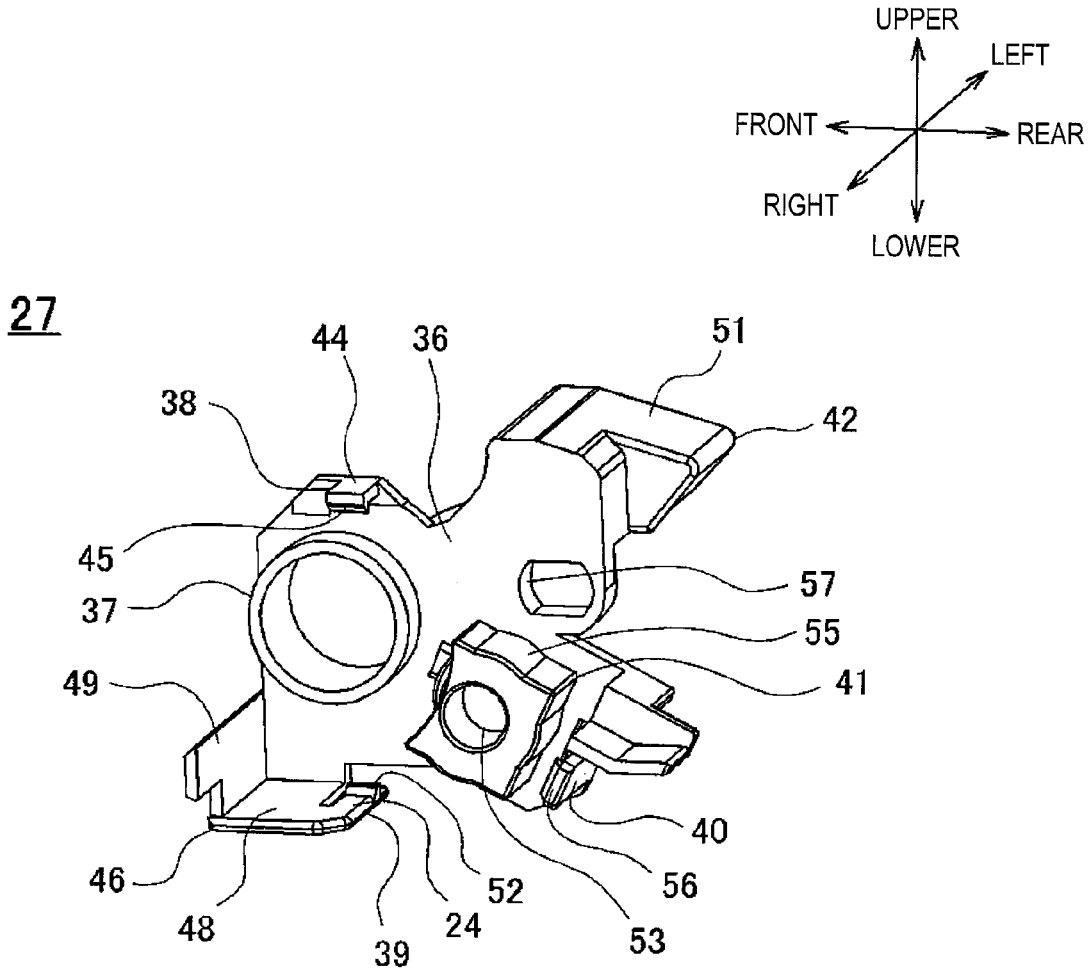
FIG. 7 is a perspective view of a supporting member viewed from a right side.
Figure 8:
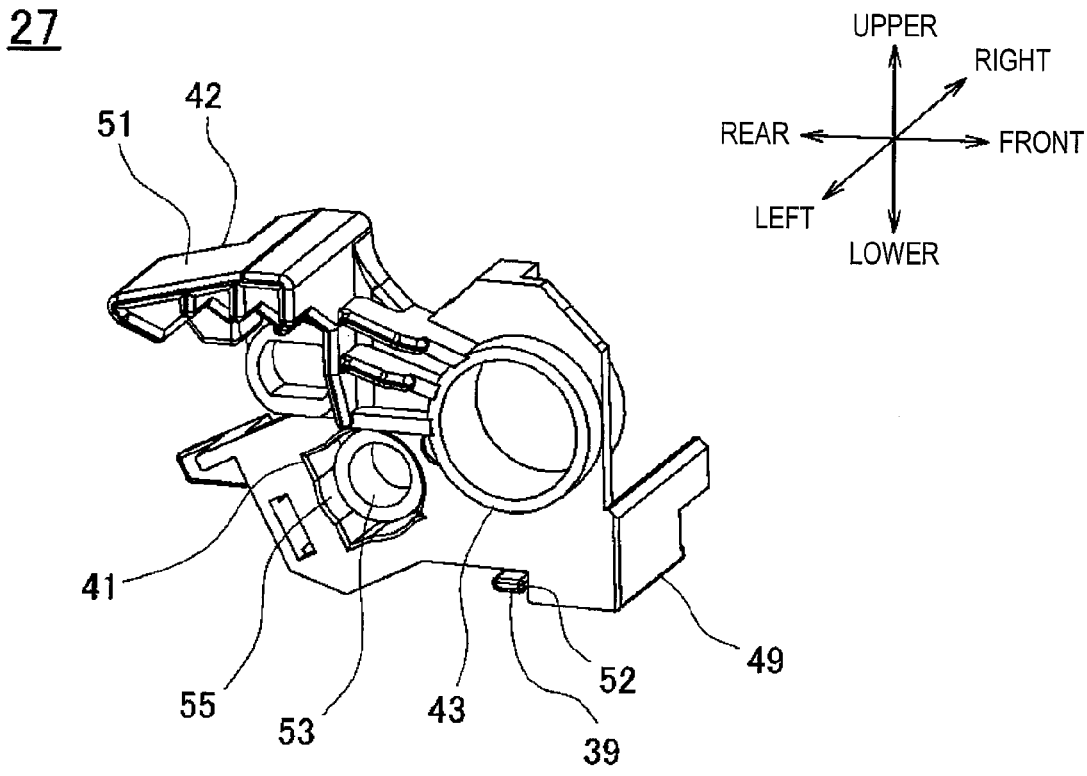
FIG. 8 is a perspective view of the supporting member viewed from a left side.
Figure 9:
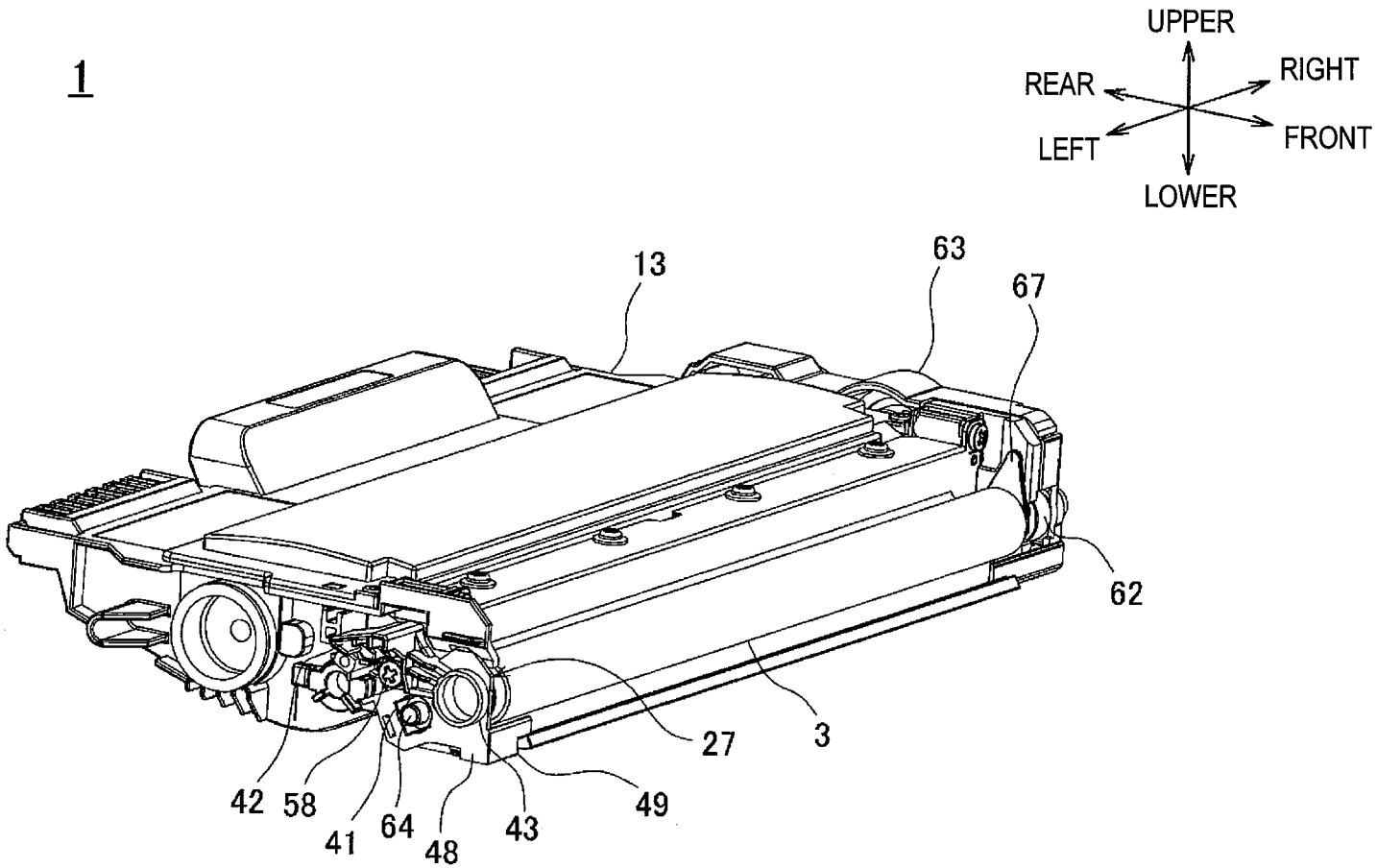
FIG. 9 is a perspective view of the developer cartridge.

The supporting member 27 is formed by conductive resin. As shown in FIGS. 7 and 8, the supporting member 27 includes a body 36, a developing roller supporting portion 37, first to third engaging portions 38 to 40 and a terminal portion 42, which are integrally formed with each other.

As the supporting member 27 is formed by conductive resin, the developing roller 3 can be charged via the supporting member 27 from the laser printer body, and other members for charging the developing roller 3 do not need to be provided.

The developing roller supporting portion 37 is arranged at a front side of the body 36, protrudes cylindrically to the right direction, and is pressed into an inner circumference of the extension part 65 of the developing roller 3. An outer diameter D1 of the developing roller supporting portion 37 is set, so that an outer surface of the developing roller supporting portion 37 contacts an inner surface of the roller body 11 (inner diameter D2), and the rotation of the developing roller 3, are possible. Conductive grease is coated on an outer circumference surface of the developing roller supporting portion 37 in advance.

A cylindrical reinforcing portion 43 which is coaxial with the developing roller supporting portion 37 and has the same inner and outer diameters as those of the developing roller supporting portion 37 protrudes to the left direction from the left side of the body 36. The reinforcing portion 43 reinforces the supporting member 27, and prevents cavities formed by mold shrinking during metallic molding.

The first engaging portion 38 is provided upper to the developing roller supporting portion 37, and includes an extension part 44 extending from the upper edge of the body 36 and a first engaging claw 45 formed at the leading edge of the extension part 44. When the extension part 44 is inserted into the engaging hole 25 of the developing casing 13, the first engaging claw 45 engages with the right surface 23 of the right partition 34 (see FIG. 3).

A leakage preventing member 46 protrudes to the right direction from a front edge and a lower edge of the body 36. The leakage preventing member 46 includes a bottom cover 48 covering the bottom of the side seal attaching portion 47 and a front cover 49 covering the front of the side seal attaching portion 47. Thus, the developer will not leak from the developing casing 13.

The second engaging portion 39 extends from the bottom cover 48. The second engaging portion 39 is provided with a bended portion 24 that is bended to the left direction from the right end of the bottom cover 48, and a second engaging claw 52 that is formed at the left end of the bended portion 24. The second engaging claw 52 engages with the second engaging portion 26 when the supporting member 27 is attached to the developing casing 13.

The terminal portion 42 is provided at the upper rear side of the body 36. The terminal portion 42 protrudes to the left direction from the upper edge of the body 36, and a contact surface 51 that inclines downwards in the rear direction is provided. By elastically contacting the contact surface 51 with a body side electrode provided in the laser printer body when the drum cartridge 2 to which the developer cartridge 1 is installed to the laser printer body, the developing roller 3 is charged via the supporting member 27.

A screw hole 57 is formed lower to the terminal portion 42. By screwing a screw 58 into the screw hole 57 (see FIG. 9), the supporting member 27 is firmly secured to a left side surface of the left sidewall 14 of the developing casing 13.

The supply roller supporting portion 41 is arranged obliquely below the developing roller supporting portion 37, and supports the shaft 64 of the supply roller 5 (see FIG. 5). The supply roller supporting portion 41 is provided with an outer frame 55 that is rectangular and recessed in the right direction and a supply roller shaft receiving unit 53 that is provided in the center of the outer frame 55 and covers the shaft 64 of the supply roller 5.

The third engaging portion 40 is provided obliquely below the supply roller supporting portion 41. The third engaging portion 40 in which a third engaging claw 56 protruding to the right direction is provided engages with the third engaged portion that was previously explained and not shown.

Next, the right end of the developer cartridge 1 will be described. As shown in FIG. 4, at the right end of the developer cartridge 1, the shaft receiving member 61 receiving the shaft end 28 of the developing roller 3, the developing roller gear 62 driving the developing roller 3, and two ring members 59 and 60 are provided.

The shaft receiving member 61 is fitted to the outer circumference of the first shaft 30 of the developing roller 3. The shaft receiving member 61 includes a base 66 and a flange 67 provided at the left edge of the base 66. It can be seen from the cross section view that, the base 66 has such a shape that two round areas are truncated linearly. The flange 67 protrudes in the radial direction from the linear portions (not shown) of the base 66. A protrusion (not shown) that engages with an engaging groove (not shown) formed at the left side of the right sidewall 15 of the developing casing 13 is formed at the right side of the flange 67.

Similar to the shaft receiving member 61, the developing roller gear 62 is fitted to the first shaft 30 at the right side of the shaft receiving member 61, and transmits the driving force transmitted from the laser printer body to the developing roller 3.

The first ring member 59 and the second ring member 60 are fitted to the first groove 32 and the second groove 33 to nip the shaft receiving member 61 and the developing roller gear 62, and the positions of the shaft receiving member 61 and the developing roller gear 62 in relation to the developing roller 3 are determined.

In addition, a gear cover 63 (see FIG. 9) is attached to the developing casing 13 to protect the developing roller gear 62 and other gears (not shown) for driving the supply roller 5, and the like.

Hereinafter, assembly of the developer cartridge 1 and the installation of the developer cartridge 1 to the drum cartridge 2 will be described.

The shaft receiving member 61 and the developing roller gear 62 are installed to the first shaft 30 of the developing roller 3. The ring member 59 and the ring member 60 are fitted to the first groove 32 and the second groove 33 to nip the shaft receiving member 61 and the developing roller gear 62, and the shaft receiving member 61 and the developing roller gear 62 are secured in relation to the shaft end 28 of the developing roller 3.

Next, the right end of the developing roller 3 is attached to the developing casing 13. Specifically, the base 66 of the shaft receiving member 61 is inserted into the right attaching groove 35 so that the flange 67 of the shaft receiving member 61 is arranged in the opening 70 when viewed from the axial direction. Then, the flange 67 is rotated counterclockwise when viewed from the left side, and a protrusion (not shown) provided on the flange 67 engages with an engaging groove (not shown) of the developing casing 13.

In this case, the right partition 34 is fitted between the left side of the developing roller gear 62 and the right side of the flange 67 formed at the shaft receiving member 61, and the position of the developing roller 3 in the axial direction in relation to the developing casing 13 is determined.

In addition, a collar (not shown) formed by resin is attached to the second shaft 31 provided at the right end of the developing roller 3.

Next, at the left end of the developing roller 3, the extension part 65 of the roller body 11 is arranged in the left attaching groove 21. Then, the developing roller supporting portion 37 of the supporting member 27 is inserted into the inner circumference of the extension part 65 of the developing roller 3 while the shaft 64 of the supply roller 5 is inserted into the supply roller shaft receiving unit 53. The first engaging portion 38, the second engaging portion 39 and the third engaging portion 40 are respectively engaged with the first engaged portion 68, the second engaged portion 26 and the third engaged portion (not shown), and the supporting member 27 is thereby attached to the developing casing 13.

When the supporting member 27 is attached to the developing casing 13, as shown in FIG. 3, the extension part 65 of the roller body 11, into which the developing roller supporting portion 37 of the supporting member 27 is inserted, is spaced from an inner surface of the left attaching groove 21 of the developing casing 13 by a radial space S1 in the radial direction. In addition, a left end side of the extension part 65 is spaced from a right side of the body 36 of the supporting member 27 by an axial space S2 in the axial direction.

Figure 10:
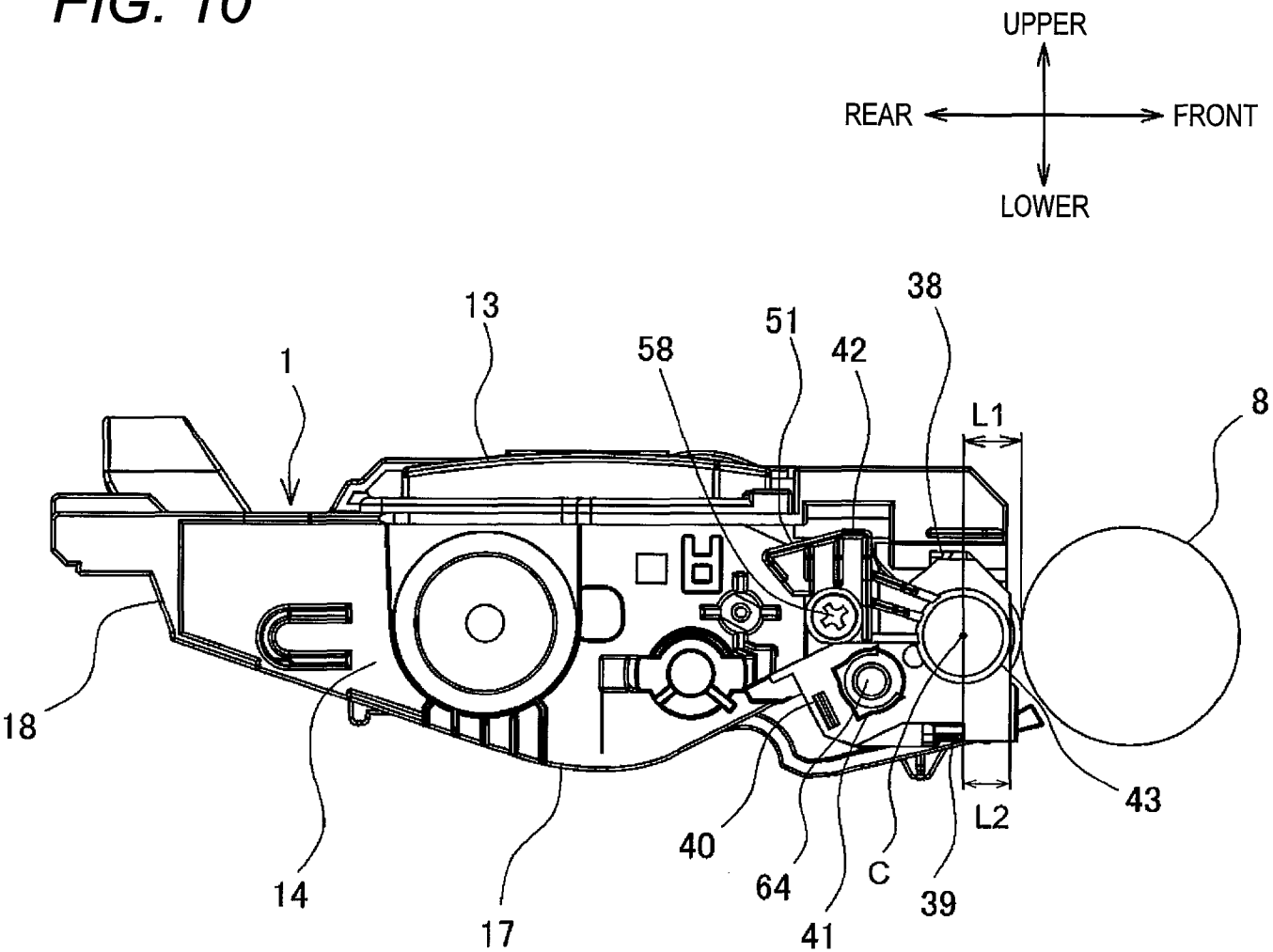
FIG. 10 is a side view showing a positional relationship between the supporting member and a photosensitive drum in a front-rear direction.
Figure 11:
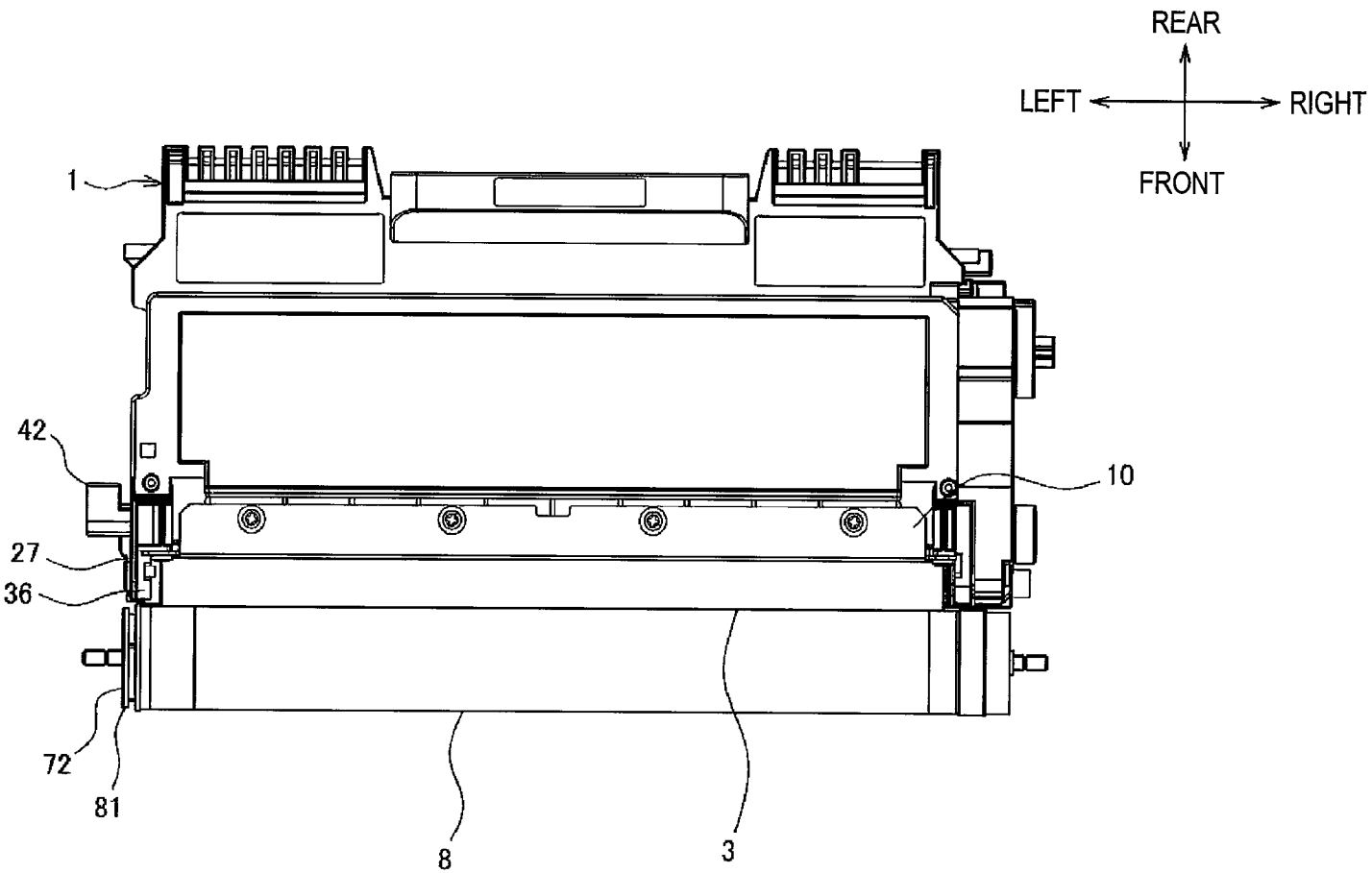
FIG. 11 is a side view showing the positional relationship between the supporting member and the photosensitive drum in an axial direction.

Next, the developing casing 13 to which the developing roller 3 and the supporting member 27 are attached is installed to the drum cartridge 2. In this case, as shown in FIG. 11, the body 36 of the supporting member 27 is arranged at the right side of the end face 72 of the flange 81 provided at the left side of the photosensitive drum 8. In addition, as shown in FIG. 10, a distance L1 from an axis center C of the developing roller 3 to the surface of the photosensitive drum 8 is set to be larger than a distance L2 from the axis center C of the developing roller 3 to the end face (the front end face of the body 36) of the supporting member 27, facing the photosensitive drum 8.

According to the developer cartridge 1 of the exemplary embodiment, the developing roller supporting portion 37 of the supporting member 27 is inserted to the inner circumference of the extension part 65 of the developing roller 3, and the left end of the developing roller 3 is attached to the developing casing 13. Therefore, compared to related-art where a shaft end is attached to a hollow developing roller, and the shaft end is received by another section so as to attach the developing roller to the developing casing, as the roller body 11 can be directly supported by the supporting member 27, axial accuracy of the developing roller 3 in relation to the developing casing 13 can be improved.

In addition, as the supporting member 27 supports the inner surface of the roller body 11 when the developing roller 3 is attached to the developing casing 13, the distance L1 from the axis center C of the developing roller 3 to the surface of the photosensitive drum 8 can be set to be larger than the distance L2 from the axis center C of the developing roller 3 to the end face of the supporting member 27, facing the photosensitive drum 8. Therefore, even if a part of the supporting member 27 is arranged at the right side of the end face 72 of the photosensitive drum 8, the developing roller 3 can be supported by the developing casing 13 without the supporting member 27 interfering with the photosensitive drum 8, and the developer cartridge 1 can be reduced in size in the axial direction.

In addition, by contacting the outer circumferential surface of the cylindrical developing roller supporting portion 37 with the inner circumferential surface of the roller body 11 to support the developing roller 3, the left end of the roller body 11 can be stably secured to the developing casing 13.

In addition, by attaching the supporting member 27 to the developing casing 13 so that the first engaging portion 38, the second engaging portion 39 and the third engaging portion 40 provided at the supporting member 27 respectively engages with the first engaged portion 68, the second engaged portion 26 and the third engaged portion (not shown), the supporting member 27 can be firmly secured to the developing casing 13.

In addition, by determining the axial position of the developing roller 3 in relation to the developing casing 13 at the right end to which the developing roller gear 62 of the developing roller 3 is attached, at the left side, it is only required that the developing roller 3 is supported by inserting the developing roller supporting member 37 of the supporting member 27 into the extension part 65 of the roller body 11. Therefore, the structure of the supporting member 27 can be simplified.

In addition, when determining a position of an apparatus in a certain direction, if the distance between a place restricting movement of the apparatus in one direction and a place restricting the movement of the apparatus in another direction becomes long, the apparatus tends to become shaky and positioning accuracy becomes lower. Meanwhile, if the distance becomes short, it becomes less shaky and the positioning accuracy becomes higher. In the exemplary embodiment, by determining the position only at the right end of the developing roller 3 rather than at both the left and right ends which are far away, the positioning accuracy can be improved, and the erection tolerance of the developing roller 3 in relation to the developing casing 13 can be reduced.

In addition, by coating conductive grease at the outer circumference of the developing roller supporting portion 37, the conductivity between the roller body 11 and the supporting member 27 can be improved, and thus necessary bias can be stably applied to the developing roller 3.

In addition, by providing the radial space S1 between the outer surface of the extension part 65 of the roller body 11 and the inner surface of the left attaching groove 21, contact area between the developing roller 3 and the developing casing 13 can be reduced, and frictional force acting on the rotating developing roller 3 can be reduced.

In addition, by providing the axial space S2 between the left end of the extension part 65 and the right side of the body 36 of the supporting member 27, the contact area between the developing roller 3 and the supporting member 27 can be reduced, and the frictional force acting on the rotating developing roller 3 can be reduced.

While the present invention has been shown and described with reference to exemplary embodiments thereof, it will be understood by those skilled in the art that various changes in form and details may be made therein without departing from the spirit and scope of the invention.

What is claimed is:

1. A processing unit, comprising:

a housing;

a developing roller configured to carry developer on a surface thereof, the developing roller including, a roller body, and a covering layer covering an outer circumferential surface of the roller body;

a photosensitive drum that contacts the developing roller, wherein an end face of the photosensitive drum at a first side in an axial direction of the developing roller is located at an outer side in the axial direction compared to an end face of the developing roller at the first side in the axial direction, and wherein the developer on the developing roller is supplied to the photosensitive drum; and a supporting member that contacts an inner circumferential surface of the roller body at the first side in the axial direction, and supports the developing roller rotatably in the housing.

2. The processing unit according to claim 1, wherein the developing roller is driven by a driving force transmitted from a second side in the axial direction, and the position of the developing roller to the housing in the axial direction is determined at the second side in the axial direction.

3. The processing unit according to claim 1, wherein the supporting member includes a cylindrical developing roller supporting portion that extends in the axial direction and supports the developing roller by contacting an outer circumferential surface thereof with the inner circumferential surface of the roller body.

4. The processing unit according to claim 1, wherein the supporting member includes an engaging portion that engages with an engaged portion provided at the housing.

5. The processing unit according to claim 1, wherein the supporting member is formed by conductive resin.

6. The processing unit according to claim 5, wherein conductive grease is coated between the inner circumferential surface of the roller body and the supporting member.

7. The processing unit according to claim 1, wherein a first space is formed in the axial direction between an end face of the roller body at the first side in the axial direction and the supporting member.

8. The processing unit according to claim 1, wherein a second space is formed in a radial direction of the developing roller between the outer circumferential surface of the roller body at the first side in the axial direction and the housing.

9. The processing unit according to claim 1, wherein the covering layer is formed by an elastic rubber layer.

10. The processing unit according to claim 1, wherein a coating solvent is coated on the outer circumferential surface of the roller body of the developing roller to form the covering layer.

* * * * *